US012781603B2

(12) United States Patent
Cao et al.

(10) Patent No.: US 12,781,603 B2
(45) Date of Patent: Nov. 3, 2026

(54) METHODS FOR IN-DEPTH FLUID DIVERSION AND STAGE BY STAGE FLUID DIVERSION SYSTEMS

(71) Applicant: Saudi Arabian Oil Company, Dhahran (SA)

(72) Inventors: Dongqing Cao, Beijing (CN); Xuan Zhang, Beijing (CN); Tianping Huang, Beijing (CN); Mohammed Badri AlOtaibi, Dhahran (SA); Lyla Maskeen, Dhahran (SA); Ziyad Kaidar, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/308,960

(22) Filed: Aug. 25, 2025

(65) Prior Publication Data

US 2026/0298059 A1 Oct. 1, 2026

Related U.S. Application Data

(62) Division of application No. 19/094,095, filed on Mar. 28, 2025, now Pat. No. 12,655,730.

(51) Int. Cl.
*E21B 43/14* (2006.01)
*E21B 43/17* (2006.01)

(52) U.S. Cl.
CPC ..... *E21B 43/14* (2013.01); *E21B 43/17* (2013.01)

(58) Field of Classification Search
CPC ..... E21B 43/14; E21B 43/17
See application file for complete search history.

(56) References Cited

U.S. PATENT DOCUMENTS

| | | | | |
|---|---|---|---|---|
| 4,458,760 | A * | 7/1984 | Hurd | C09K 8/584 166/270.1 |
| 2006/0000609 | A1* | 1/2006 | Cavazzoli | E21B 43/26 166/280.1 |
| 2011/0265994 | A1* | 11/2011 | Entchev | C09K 8/508 166/270 |
| 2015/0013969 | A1* | 1/2015 | Dawson | E21B 43/16 166/250.1 |
| 2020/0140743 | A1* | 5/2020 | O'Reilly | C08F 230/02 |
| 2021/0380866 | A1* | 12/2021 | Kaidar | C09K 8/588 |
| 2025/0052146 | A1* | 2/2025 | Almohsin | E21B 47/117 |

* cited by examiner

*Primary Examiner* — Silvana C Runyan
(74) *Attorney, Agent, or Firm* — Fish & Richardson P.C.

(57) ABSTRACT

A method for in-depth fluid diversion includes a first step and one or more second steps. The first step includes simultaneously introducing a preformed particle gel (PPG) material and one or more shrinking agents to a first position in a high-permeability zone via an injection well, and introducing water into the high-permeability zone via the injection well, thereby contacting the water with the PPG material to form water-swelled PPG particles within fractures of the high-permeability zone at the first position. The water-swelled PPG particles in the high-permeability zone can pack the fractures, thereby generating a fluid diversion to control the water flow to an adjacent low-permeability zone. A stage-by-stage fluid diversion system is also disclosed.

20 Claims, 9 Drawing Sheets

METHODS FOR IN-DEPTH FLUID DIVERSION AND STAGE BY STAGE FLUID DIVERSION SYSTEMS

CROSS-REFERENCE TO RELATED PATENT APPLICATIONS

This application is a divisional of and claims the benefit of priority to U.S. patent application Ser. No. 19/094,095, filed Mar. 28, 2025, the contents of which are incorporated by reference herein.

TECHNICAL FIELD

The present disclosure relates to methods for fluid diversion, more particularly, to methods for in-depth fluid diversion in a heterogenous reservoir. The present disclosure also relates to stage-by-stage fluid diversion systems using preformed particle gel materials and shrinking agents.

BACKGROUND

Water flooding in heterogeneous reservoirs often results in poor sweep efficiency because the high-permeability zones dominate the flow of injected water, leaving oil in the low-permeability areas un-swept. To divert the flow and increase sweep efficiency, various solid or semi-solid plugging materials for high permeability zones, such as fractures, have been developed. Among these, polymeric gels, including bulk gels and particle gels, are used due to the low cost, reliable long-term stability, and controllable performance for both near wellbore and in-depth operations. Traditional bulk gels, however, have certain limitations due to the in-situ gelation reaction, leading to the growing popularity of preformed particle gels (PPGs) in fluid diversion applications.

SUMMARY

This disclosure describes technologies relating to methods for in-depth fluid diversion in a heterogenous reservoir, and stage-by-stage fluid diversion systems using preformed particle gel materials and shrinking agents.

DETAILED DESCRIPTION

Figure 1:
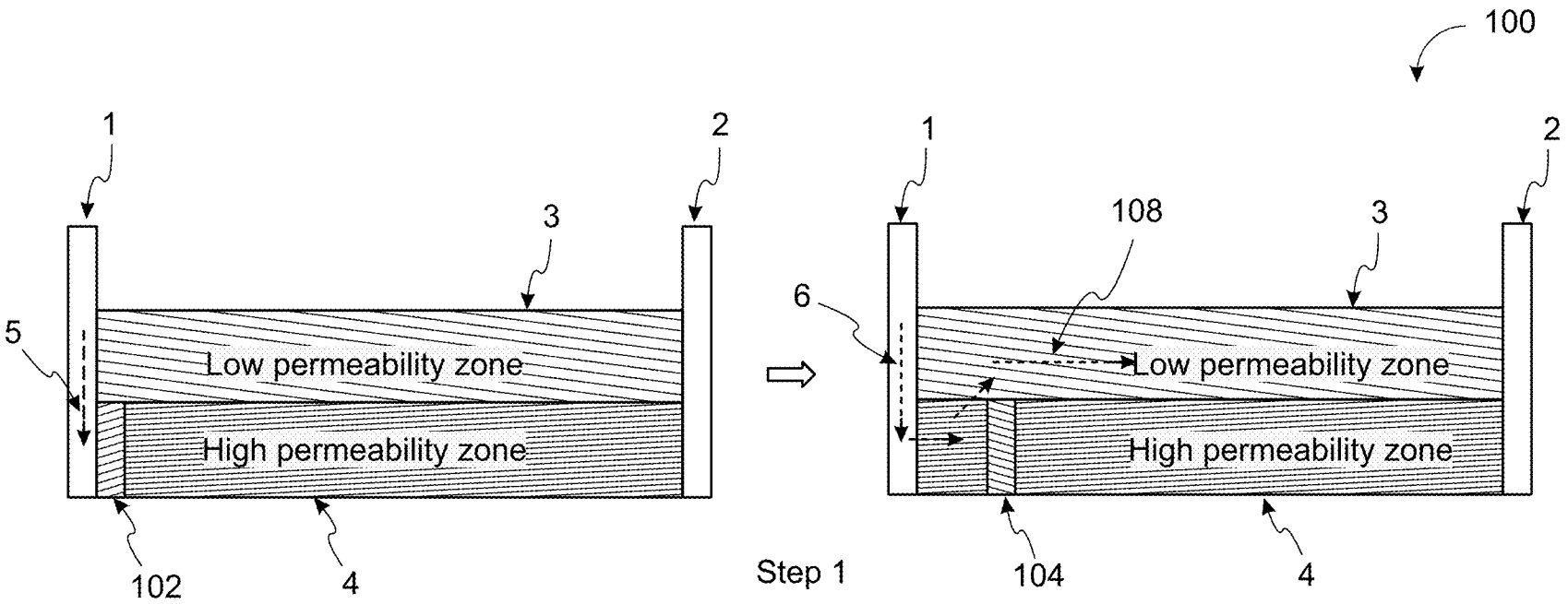
FIG. 1 is a schematic diagram illustrating a first step of a method for in-depth fluid diversion using a stage-by-stage injection system, according to certain embodiments of the present disclosure.

Water flooding in heterogeneous reservoirs often suffers from poor sweep efficiency, as high-permeability zones dominate the flow of injected water, leaving oil in low-permeability areas un-swept. To enhance sweep efficiency and redirect flow, various solid or semi-solid plugging materials have been developed to target high-permeability zones, such as fractures and voids. Among these, polymeric gels—including bulk gels and particle gels—are used due to their low cost, long-term stability, and controllable performance for both near-wellbore and in-depth applications. PPGs are water-absorbent materials capable of swelling to several times their initial volume upon water absorption. The basic mechanism of PPG injection involves particle packing and blockage in high-permeability zones, which is highly dependent on particle size and flow channel distribution. Despite their advantages, PPGs face limitations, including their tendency to become trapped in or near the wellbore area, which diminishes their effectiveness in deeper reservoirs. Additionally, PPG packing is irreversible, as the plugging effect occurs as a one-time process fixed in position, restricting their flexibility and adaptability to dynamic reservoir conditions. Bulk gels, however, have limitations related to in-situ gelation reactions, leading to the increasing use of preformed particle gel (PPG) materials in fluid diversion applications. PPG is a water-absorbent material capable of swelling to several times its initial volume upon water absorption. The primary mechanism of PPG material injection involves particle packing and blocking within high-permeability zones, which is highly dependent on particle size and flow channel distribution.

Accordingly, there is a need to develop alternative methods that are cost-effective, efficient in diverting flow, and capable of enhancing sweep efficiency.

Implementing the techniques described here can provide in-depth fluid diversion in a heterogenous reservoir. The techniques can also be implemented as a stage-by-stage injection system.

Provided in the present disclosure are methods for diverting fluid using preformed particle gel (PPG) materials. PPG, as a water-swollen particulate material, can divert flooding water flow to adjacent low-permeability areas by blocking high-permeability channels such as fractures and voids. The shrinking agent, which includes ultra-high salinity water and solvents like ethanol, facilitates PPG migration through the wellbore into deeper reservoir zones by shrinking or dehydrating the swollen PPG particles to shrunken PPG particles with reduced particle size. A stage-by-stage injection system is used in the oilfield applications to divert flow at different positions, from the near-wellbore region to deeper parts of the reservoir. In a first stage, PPG material is co-injected with a shrinking agent as carrier fluid. This prevents swelling, keeping the PPG material particles small and allowing them to migrate easily into high-permeability zones. Once normal water injection resumes, the shrinking agent is displaced, causing the PPG material particles to swell and choke the water flow, thereby creating fluid diversion at a first position. In a second stage, the shrinking agent is injected alone to replace the normal injection water. This causes the packed PPG material to break as the PPG material particles shrink back to a smaller particle size. The released PPG material particles then migrate further into the reservoir. When normal water injection resumes, the PPG material swells and repacks in deeper zones, generating fluid diversion at a second position. Additional stages, following the second stage process, can be implemented as needed to enhance reservoir water-flooding efficiency and improve sweep performance.

Figure 8:
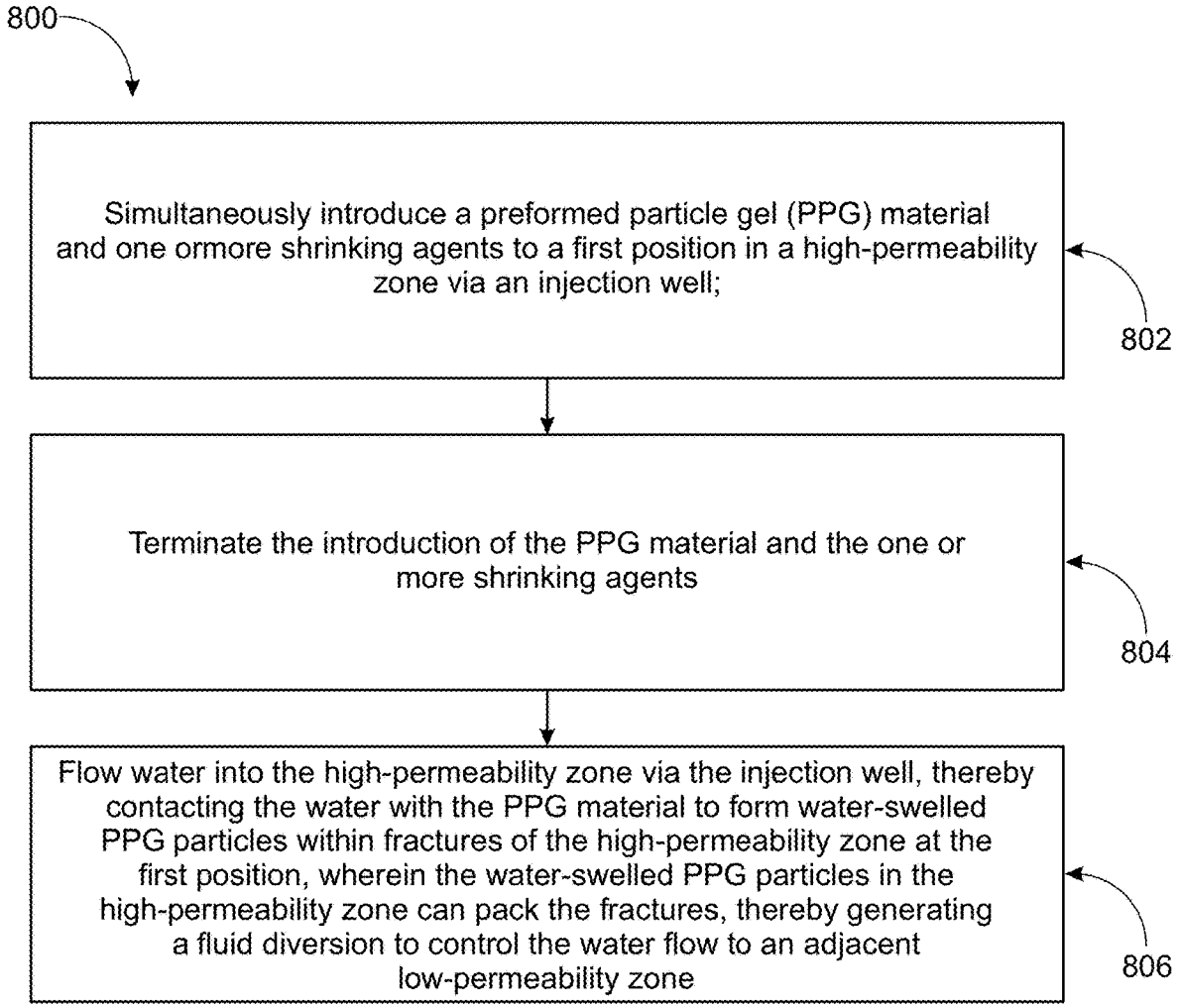
FIG. 8 is a flow chart depicting a first step (800) of a method for in-depth fluid diversion in a heterogenous reservoir, the first step (800) of the method for in-depth fluid diversion can be implemented through the first stage (100) of the stage-by-stage fluid diversion system, according to certain embodiments of the present disclosure.
Figure 9:
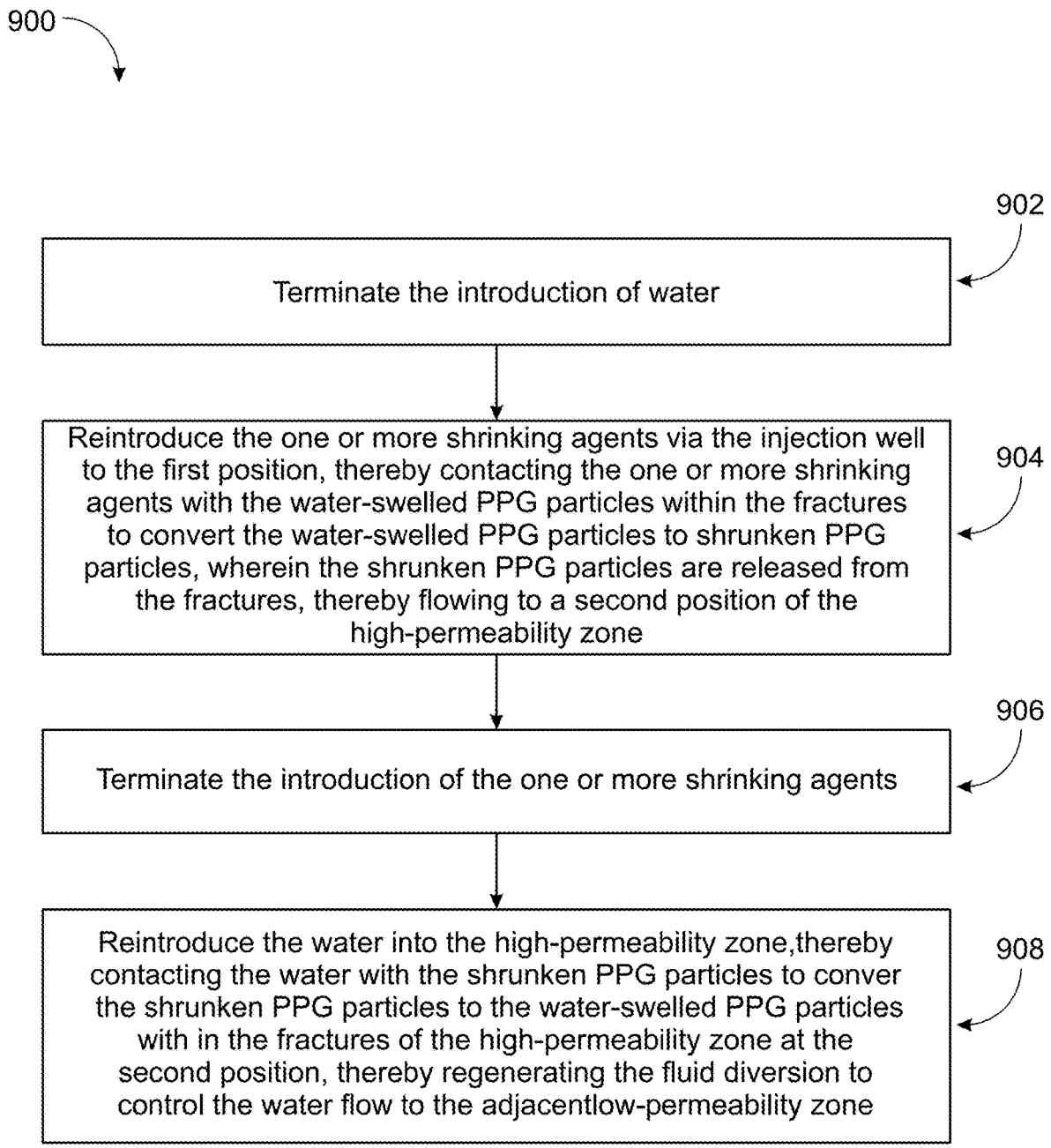
FIG. 9 is a flow chart depicting a second step (900) of the method for in-depth fluid diversion, the second step (900) of the method can be implemented through the second stage (200) of the stage-by-stage fluid diversion system, according to certain embodiments of the present disclosure.

The method for in-depth fluid diversion in a heterogenous reservoir includes a first step (800), as depicted in FIG. 8, and one or more second steps (900), as depicted in FIG. 9. The order in which the method is described is not intended to be construed as a limitation, and any number of the described method steps can be combined in any order to implement the method for in-depth fluid diversion. Additionally, individual steps may be removed or skipped from the method without departing from the spirit and scope of the present disclosure. In some embodiments, the first step (800) of the method for in-depth fluid diversion in the heterogenous reservoir can be implemented through the first stage (100) of the stage-by-stage fluid diversion system. In some embodiments, the second step (900) of the method for in-depth fluid diversion can be implemented through the second stage (200) of the stage-by-stage fluid diversion system.

In some embodiments, the first step (800) includes (802) simultaneously introducing a preformed particle gel (PPG) material and one or more shrinking agents to a first position in a high-permeability zone via an injection well. The first step further includes (804) terminating the introduction of the PPG material and the one or more shrinking agents. The first step further includes (806) introducing water into the high-permeability zone via the injection well, thereby contacting the water with the PPG material to form water-swelled PPG particles within fractures of the high-permeability zone at the first position. In some embodiments, the water-swelled PPG particles in the high-permeability zone can pack the fractures, thereby generating a fluid diversion to control the water flow to an adjacent low-permeability zone.

In some embodiments, the one or more second steps (900) include (902) terminating the introduction of water; and (904) reintroducing the one or more shrinking agents via the injection well to the first position, thereby contacting the one or more shrinking agents with the water-swelled PPG particles within the fractures to convert the water-swelled PPG particles to shrunken PPG particles. In some embodiments, the shrunken PPG particles are released from the fractures, thereby flowing to a second position of the high-permeability zone.

In some embodiments, the one or more second steps (900) further include (906) terminating the introduction of the one or more shrinking agents; and (908) reintroducing the water into the high-permeability zone, thereby contacting the water with the shrunken PPG particles to convert the shrunken PPG particles to the water-swelled PPG particles within the fractures of the high-permeability zone at the second position, thereby regenerating the fluid diversion to control the water flow to the adjacent low-permeability zone.

The PPG material of the present disclosure are water dispersible polymer particles, typically crosslinked polymer particles. The PPG material particles may swell after their addition to an aqueous fluid, such as water. The water includes, but is not limited to, fresh or salt water, brine, produced water, flowback water, and/or brackish water. In some embodiments, the PPG materials are prepared by first forming a bulk gel comprising a polymer, copolymer, and/or a terpolymer, such as a polymer and/or copolymer comprising acrylamide monomers and/or acrylic acid monomers and/or a terpolymer comprising acrylamide, acrylic acid, and ATBS, a crosslinker, such as MBA, and a filler, such as clay. The PPG material may be subsequently mechanically processed, e.g., by crushing and/or grinding, to produce particles of a desired size range. In some embodiments, the PPG materials are prepared off-site, then brought to a desired location for use. In some embodiments, the PPG materials are deformable, which property facilitates their flowing through porous media even when the PPG material particles are larger than the pore throats.

In some embodiments, the PPG material is prepared from a composition comprising one or more monomers, one or more crosslinkers, and one or more fillers. In some embodiments, the one or more monomers are present in the composition in an amount of from about 20 to about 95 wt. %, such as about 30 to about 90 wt. %, about 40 to about 85 wt. %, about 50 to about 80 wt. %, about 60 to about 75 wt. %, or about 25 wt. %, about 35 wt. %, about 45 wt. %, about 55 wt. %, about 65 wt. %, about 75 wt. %, about 85 wt. %, or about 95 wt. %, each wt. % based on a total weight of the composition. In some embodiments, the one or more crosslinkers are present in the composition in an amount of from about 0.01 to about 5 wt. %, such as about 0.05 to about 4.8 wt. %, about 0.1 to about 4.6 wt. %, about 0.3 to about 4.4 wt. %, about 0.5 to about 4.2 wt. %, about 0.7 to about 4 wt. %, about 0.9 to about 3.8 wt. %, about 1.1 to about 3.6 wt. %, about 1.3 to about 3.4 wt. %, about 1.5 to about 3.2 wt. %, about 1.7 to about 3 wt. %, about 1.9 to about 2.8 wt. %, about 2.1 to about 2.6 wt. %, about 2.3 to about 2.4 wt. %, or about 0.01 wt. %, about 0.15 wt. %, about 0.35 wt. %, about 0.55 wt. %, about 0.75 wt. %, about 0.95 wt. %, about 1.15 wt. %, about 1.35 wt. %, about 1.55 wt. %, about 1.75 wt. %, about 1.95 wt. %, about 2.15 wt. %, about 2.35 wt. %, about 2.55 wt. %, about 2.75 wt. %, about 2.95 wt. %, about 3.15 wt. %, about 3.35 wt. %, about 3.55 wt. %, about 3.75 wt. %, about 3.95 wt. %, about 4.15 wt. %, about 4.35 wt. %, about 4.55 wt. %, about 4.75 wt. %, or about 4.95 wt. %, each wt. % based on the total weight of the composition. In some embodiments, the one or more fillers are present in the composition in an amount of from about 1 to about 40 wt. %, such as about 5 to about 35 wt. %, about 10 to about 30 wt. %, about 15 to about 25 wt. %, or about 5 wt. %, about 10 wt. %, about 15 wt. %, about 20 wt. %, about 25 wt. %, about 30 wt. %, or about 35 wt. %, each wt. % based on the total weight of the composition.

In some embodiments, the one or more monomers are selected from the group consisting of acrylamide (AM), acrylic acid (AA), and 2-acrylamido-2-methylpropane sulfonic acid (AMPS).

In some embodiments, the one or more monomers include acrylamide selected form the group consisting of methacrylamide, N, N-dimethyl (meth)acrylamide, 2-acrylamidoglycolic acid, N-hydroxypropylacrylamide, N-hydroxyethyl acrylamide, N-(tris(hydroxymethyl)methyl)-acrylamide, N-2-aminoethyl (meth)acrylamide hydrochloride, N-3-aminopropyl (meth)acrylamide hydrochloride, and combinations thereof.

In some embodiments, the acrylamide is present in the composition in an amount of from about 20 to about 95 wt. %, such as about 30 to about 90 wt. %, about 40 to about 85 wt. %, about 50 to about 80 wt. %, about 60 to about 75 wt. %, or about 25 wt. %, about 35 wt. %, about 45 wt. %, about 55 wt. %, about 65 wt. %, about 75 wt. %, about 85 wt. %, or about 95 wt. %, each wt. % based on a total weight of the composition.

The one or more crosslinkers are covalent and result from crosslinking within the PPG material. The crosslinker is an ethylenically unsaturated monomer that contains either: (i) two sites of ethylenic unsaturation (i.e., two ethylenically unsaturated double bonds); (ii) an ethylenically unsaturated double bond along with a functional group that reacts with a functional group (e.g., an amide group) of the polymer chains in the PPG material; or (iii) multiple functional groups that react with the polymer chains' functional groups. In some embodiments, the degree of crosslinking in the PPG material herein is selected to control the amount of swelling (i.e., fluid absorption or volume expansion) of the PPG material.

In some embodiments, the one or more crosslinkers are selected from the group consisting of N,N-methylenebisacrylamide (MBA), diallyldimethylammonium chloride (DADMAC), and poly(ethylene glycol) diacrylate (PEGDA). In some embodiments, the one or more crosslinkers are MBA. In some embodiments, the one or more crosslinkers are DADMAC. In some embodiments, the one or more crosslinkers are PEGDA.

In some embodiments, the one or more crosslinkers are MBA. The MBA are present in the composition in an amount of from about 0.01 to about 5 wt. %, such as about 0.05 to about 4.8 wt. %, about 0.1 to about 4.6 wt. %, about 0.3 to about 4.4 wt. %, about 0.5 to about 4.2 wt. %, about 0.7 to about 4 wt. %, about 0.9 to about 3.8 wt. %, about 1.1 to about 3.6 wt. %, about 1.3 to about 3.4 wt. %, about 1.5 to about 3.2 wt. %, about 1.7 to about 3 wt. %, about 1.9 to about 2.8 wt. %, about 2.1 to about 2.6 wt. %, about 2.3 to about 2.4 wt. %, or about 0.01 wt. %, about 0.15 wt. %, about 0.35 wt. %, about 0.55 wt. %, about 0.75 wt. %, about 0.95 wt. %, about 1.15 wt. %, about 1.35 wt. %, about 1.55 wt. %, about 1.75 wt. %, about 1.95 wt. %, about 2.15 wt. %, about 2.35 wt. %, about 2.55 wt. %, about 2.75 wt. %, about 2.95 wt. %, about 3.15 wt. %, about 3.35 wt. %, about 3.55 wt. %, about 3.75 wt. %, about 3.95 wt. %, about 4.15 wt. %, about 4.35 wt. %, about 4.55 wt. %, about 4.75 wt. %, or about 4.95 wt. %, each wt. % based on the total weight of the composition.

In some embodiments, the one or more fillers are selected from the group consisting of bentonite, lignocellulose, laponite, montnorillonite, diatomite, kaolinoite, titania, silicate, clay, calcium carbonate, and silica. In some embodiments, the one or more fillers are selected from the group consisting of clay, calcium carbonate, and silica. In some embodiments, the one or more fillers are clay. In some embodiments, the one or more fillers are calcium carbonate. In some embodiments, the one or more fillers are silica.

In some embodiments, the one or more fillers are clay. The clay are present in the composition in an amount of from about 1 to about 40 wt. %, such as about 5 to about 35 wt. %, about 10 to about 30 wt. %, about 15 to about 25 wt. %, or about 5 wt. %, about 10 wt. %, about 15 wt. %, about 20 wt. %, about 25 wt. %, about 30 wt. %, or about 35 wt. %, each wt. % based on the total weight of the composition.

The composition used to prepare the PPG material may further include one or more initiators, one or more peroxides, one or more bases, one or more reducing promoters, one or more regulators, one or more stabilizers, one or more chelating agents, one or more thermal agents, one or more chain-transfer agents, one or more oxygen scavengers, and one or more pH adjusters.

In some embodiments, the one or more initiators include, but are not limited to, ammonium persulfate, potassium persulfate, sodium persulfate, sodium bromate, sodium sulfite, potassium sulfite or mixture, and 2,2'-azobis(2-methylpropiopionitrile). In some embodiments, the one or more peroxides include, but are not limited to, t-butyl peroxide, benzoyl peroxide, diisopropylbenzene peroxide, azobisisobutyronitrile. In some embodiments, the one or more bases include, but are not limited to, sodium carbonate, sodium bicarbonate, sodium hydroxide. In some embodiments, the one or more reducing promoters include, but are not limited to, potassium metabisulfite, sodium sulfite, thionyl chloride, thionyl bromide. In some embodiments, the one or more regulators include, but are not limited to, alcohols. In some embodiments, the one or more stabilizers include, but are not limited to, phenol, m-dihydroxybenzene, hydroquinone. In some embodiments, the one or more chelating agents include, but are not limited to, ethylene diamine tetra acetate (EDTA) and diethylenetriamine pentaacetate (DTPA). In some embodiments, the one or more thermal agents include, but are not limited to, 2-acrylamido-2-methyl propane sulfonic acid. In some embodiments, the one or more chain-transfer agents include, but are not limited to, thiols such as dodecyl mercaptan, formic acid, and alkali metal formates such as sodium formate. In some embodiments, the one or more oxygen scavengers include, but are not limited to, sodium sulfite, sodium bisulfite, sodium thiosulfate, sodium lignosulfate, ammonium bisulfite, hydroquinone, diethylhydroxyethanol, diethylhydroxylamine, methylethylketoxime, ascorbic acid, erythorbic acid, and sodium erythorbate. In some embodiments, the one or more pH adjusters include, but are not limited to, sodium hydroxide, ammonium hydroxide, and potassium hydroxide.

In some embodiments, the PPG material has a particle size of from about 0.01 millimeters (mm) to about 10 mm. In some embodiments, the PPG material has a particle size of from about 0.05 mm to about 9.5 mm, such as from about 0.1 mm to about 9 mm, from about 0.5 mm to about 8.5 mm, from about 1 mm to about 8 mm, from about 1.5 mm to about 7.5 mm, from about 2 mm to about 7 mm, from about 2.5 mm to about 6.5 mm, from about 3 mm to about 6 mm, from about 3.5 mm to about 5.5 mm, from about 4 mm to about 5 mm, or about 0.03 mm, about 0.13 mm, about 0.63 mm, about 1.3 mm, about 2.3 mm, about 3.3 mm, about 4.3 mm, about 5.3 mm, about 6.3 mm, about 7.3 mm, about 8.3 mm, or about 9.3 mm. In some embodiments, the PPG material has a particle size of from about 0.1 mm to about 9 mm. In some embodiments, the PPG material has a particle size of from about 1 mm to about 8 mm. In some embodiments, the PPG material has a particle size of from about 2 mm to about 7 mm. In some embodiments, the PPG material has a particle size of from about 3 mm to about 6 mm. In some embodiments, the PPG material has a particle size of from about 4 mm to about 5 mm. In some embodiments, the PPG material has a particle size of from about 1 mm to about 5 mm. In some embodiments, particles of the PPG material are any shape including spherical, angular, and polyhedral.

In some embodiments, the PPG material has a storage modulus of from about 100 pascals (Pa) to about 100,000 Pa. In some embodiments, the PPG material has a storage modulus of from about 200 Pa to about 95,000 Pa, such as from about 500 Pa to about 90,000 Pa, from about 1,000 Pa to about 85,000 Pa, from about 5,000 Pa to about 80,000 Pa, from about 10,000 Pa to about 75,000 Pa, from about 15,000 Pa to about 70,000 Pa, from about 20,000 Pa to about 65,000 Pa, from about 25,000 Pa to about 60,000 Pa, from about 30,000 Pa to about 55,000 Pa, from about 35,000 Pa to about 50,000 Pa, from about 40,000 Pa to about 45,000 Pa, or about 150 Pa, about 1500 Pa, about 5500 Pa, about 10,000 Pa, about 15,000 Pa, about 20,000 Pa, about 25,000 Pa, about 30,000 Pa, about 35,000 Pa, about 40,000 Pa, about 45,000 Pa, about 50,000 Pa, about 55,000 Pa, about 60,000 Pa, about 65,000 Pa, about 70,000 Pa, about 75,000 Pa, about 80,000 Pa, about 85,000 Pa, about 90,000 Pa, about 95,000 Pa, or about 100,000 Pa.

In some embodiments, the one or more shrinking agents include a salinity water and an alcohol.

In some embodiments, the salinity water has a salinity of from about 50,000 (parts per million) ppm to about 360,000 ppm. In some embodiments, the salinity water has a salinity of from about 80,000 ppm to about 330,000 ppm, such as from about 110,000 ppm to about 300,000 ppm, from about 140,000 ppm to about 270,000 ppm, from about 170,000 ppm to about 240,000 ppm, from about 200,000 ppm to about 210,000 ppm, or about 70,000 pp, about 90,000 ppm, about 110,000 ppm, about 130,000 ppm, about 150,000 ppm, about 170,000 ppm, about 190,000 ppm, about 210,000 ppm, about 230,000 ppm, about 250,000 ppm, about 270,000 ppm, about 290,000 ppm, about 310,000 ppm, about 330,000 ppm, or about 350,000 ppm. In some embodiments, the salinity water has a salinity of from 200,000 ppm to about 250,000 ppm. In some embodiments, the salinity water has a salinity of about 213,734 ppm.

In some embodiments, the alcohol is selected from the group consisting of methanol, ethanol, isopropanol, 1-propanol, ethylene glycol, 1,2-propanediol, 1,3-propanediol, diethylene glycol, and dipropylene glycol. In some embodiments, the alcohol is ethanol.

In some embodiments, the water introduced into the high-permeability zone during the first step and second step is at least one selected from the group consisting of fresh water, salt water, brine, produced water, flowback water, and/or brackish water. In some embodiments, the water introduced into the high-permeability zone is at least one selected from the group consisting of fresh water, salt water, brine, and produced water. In some embodiments, the water introduced into the high-permeability zone has a salinity of less than about 5,000 ppm, such as less than about 4,500 ppm, less than about 4,000 ppm, less than about 3,500 ppm, less than about 3,000 ppm, less than about 2,500 ppm, less than about 2,000 ppm, less than about 1,500 ppm, less than about 1,000 ppm, less than about 500 ppm, or less than about 50 ppm. In some embodiments, the water introduced into the high-permeability zone has a salinity of from about 2,000 ppm to about 3,000 ppm. In some embodiments, the water introduced into the high-permeability zone has a salinity of about 2,425 ppm.

In some embodiments, the injection well is selected from the group consisting of a vertical wellbore, a deviated wellbore, a multilateral wellbore, and a horizontal wellbore. In some embodiments, the injection well is a vertical wellbore. In some embodiments, the injection well is a horizontal wellbore.

In some embodiments, the temperature of the heterogenous reservoir is from about 40° C. to about 200° C. In some embodiments, the temperature of the heterogenous reservoir is from about 50° C. to about 180° C., such as from about 60° C. to about 160° C., from about 70° C. to about 140° C., from about 80° C. to about 120° C., or about 50° C., about 70° C., about 90° C., about 110° C., about 130° C., about 150° C., about 170° C., or about 190° C. In some embodiments, the temperature of the heterogenous reservoir is from about 60° C. to about 150° C. In some embodiments, the temperature of the heterogenous reservoir is from about 80° C. to about 120° C.

In some embodiments, a pressure at the first position of the high-permeability zone packed with the water-swelled PPG particles is about 1 to about 10 times higher, such as from about 1.5 to about 9.5 times, from about 2 to about 9 times, from about 2.5 to about 8.5 times, from about 3 to about 8 times, from about 3.5 to about 7.5 times, from about 4 to about 7 times, or about 4.5 to about 6.5 times, from about 5 to about 6 times, or about 5.5 times, compared to a pressure measured at the first position after converting the water-swelled PPG particles to shrunken PPG particles. In some embodiments, a pressure at the first position of the high-permeability zone packed with the water-swelled PPG particles is about 1 to about 5 times higher compared to a pressure measured at the first position after converting the water-swelled PPG particles to shrunken PPG particles. In some embodiments, a pressure at the first position of the high-permeability zone packed with the water-swelled PPG particles is about 1 time higher compared to a pressure measured at the first position after converting the water-swelled PPG particles to shrunken PPG particles. In some embodiments, a pressure at the first position of the high-permeability zone packed with the water-swelled PPG particles is about 2 times higher compared to a pressure measured at the first position after converting the water-swelled PPG particles to shrunken PPG particles. In some embodiments, a pressure at the first position of the high-permeability zone packed with the water-swelled PPG particles is about 3 times higher compared to a pressure measured at the first position after converting the water-swelled PPG particles to shrunken PPG particles. In some embodiments, a pressure at the first position of the high-permeability zone packed with the water-swelled PPG particles is about 4 times higher compared to a pressure measured at the first position after converting the water-swelled PPG particles to shrunken PPG particles. In some embodiments, a pressure at the first position of the high-permeability zone packed with the water-swelled PPG particles is about 5 times higher compared to a pressure measured at the first position after converting the water-swelled PPG particles to shrunken PPG particles.

In some embodiments, the second position is at a further distance than the first position relative to the injection well.

Also provided in the present disclosure are stage-by-stage fluid diversion systems for diverting fluid using PPG materials. FIG. 1 is a schematic diagram illustrating the first step of the method for in-depth fluid diversion using the stage-by-stage injection system during a first stage (100). In some embodiments, the first step (800) of the method for in-depth fluid diversion in the heterogenous reservoir corresponds to the first stage (100) of the stage-by-stage fluid diversion system.

In some embodiments, the stage-by-stage fluid diversion system of the present disclosure includes an injection well (1), a production well (2), a low-permeability zone (103), and a high-permeability zone (4). The low-permeability zone (3) can be present in the heterogenous reservoir at any position adjacent to the high-permeability zone (4). In some embodiments, the high-permeability zone (4) includes fractures, microfractures, and fracture-like features or voids that can cause channeling and/or diversion of injected fluids. In some embodiments, the high-permeability zone (4) includes fractures.

In the first stage (100), an injection fluid (5) containing a PPG material and one or more shrinking agents as the carrier fluid is introduced to an area (102) near the high-permeability zone (4) via the injection well (1). The one or more shrinking agents can maintain the PPG material in an unswollen or minimally swollen state with a particle size change of less than about 20%, such as less than about 15%, less than about 10%, less than about 5%, or less than about 1% based on an initial average particle size of the PPG material, allowing it to migrate from the area (102) easily into a first position (104) within the high-permeability zone (4). The injection fluid (5) is then stopped after the fractures in the high-permeability zone (4) are substantially filled with the PPG material. A water stream (6) is introduced into the high-permeability zone (4) via the injection well (1), thereby contacting the water stream (6) with the PPG material to form water-swelled PPG particles within fractures of the high-permeability zone (4) at the first position (104). In some embodiments, the water-swelled PPG particles in the high-permeability zone (4) can pack the fractures, thereby generating a fluid diversion (108) to control the water flow to an adjacent low-permeability zone (3). In some embodiments, the water stream (6) is at least one selected from the group consisting of fresh water, salt water, brine, produced water, flowback water, and/or brackish water. In some embodiments, the water stream (6) is at least one selected from the group consisting of fresh water, salt water, brine, and produced water. In some embodiments, the water stream (6) is brine. In some embodiments, the water stream (6) has a salinity of less than about 5,000 ppm, such as less than about 4,500 ppm, less than about 4,000 ppm, less than about 3,500 ppm, less than about 3,000 ppm, less than about 2,500 ppm, less than about 2,000 ppm, less than about 1,500 ppm, less than about 1,000 ppm, less than about 500 ppm, or less than about 50 ppm. In some embodiments, the water stream (6) has a salinity of from about 2,000 ppm to about 3,000 ppm. In some embodiments, the water stream (6) has a salinity of about 2,425 ppm.

Figure 2:
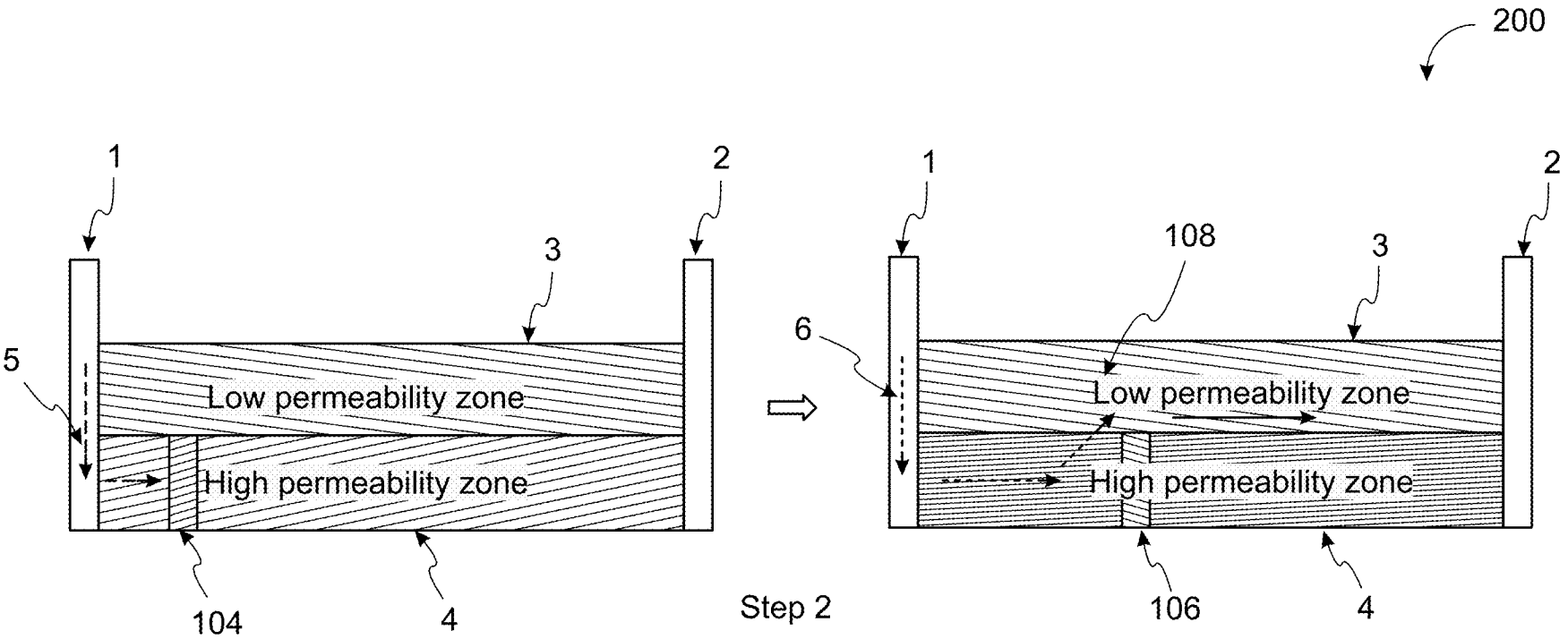
FIG. 2 is a schematic diagram illustrating a second step of the method for in-depth fluid diversion using the stage-by-stage injection system, according to certain embodiments of the present disclosure.

FIG. 2 is a schematic diagram illustrating a second step of the method for in-depth fluid diversion using the stage-by-stage injection system during a second stage (200). In some embodiments, the second step (900) of the method for in-depth fluid diversion corresponds to the second stage (200) of the stage-by-stage fluid diversion system.

In the second stage (200), the water stream (6) is terminated followed by the reintroduction of the one or more shrinking agents as the injection fluid (5) via the injection well (1) to the first position (104). At the first position (104), the one or more shrinking agents are in contact with the water-swelled PPG particles within the fractures to convert the water-swelled PPG particles to shrunken PPG particles. In some embodiments, the shrunken PPG particles are released from the fractures, thereby flowing to a second position (106) of the high-permeability zone (4). The injection fluid (5) is then terminated after the fractures at the second position (106) in the high-permeability zone (4) are substantially filled with the shrunken PPG particles. The water stream (6) is then reintroduced into the high-permeability zone (4), thereby contacting the water stream (6) with the shrunken PPG particles to convert the shrunken PPG particles to the water-swelled PPG particles within the fractures of the high-permeability zone (4) at the second position (106), thereby regenerating the fluid diversion (108) to control the water flow to the adjacent low-permeability zone (3).

Openings are present in the wellbore across the oil-bearing geologic formations, such as the low-permeability zone (3) and the high-permeability zone (4). Initially, the high-permeability zone (4) allows more fluid flow compared to the low-permeability zone (3). However, after treatment with the PPG material, areas such as the first position (104) and second position (106) within the high-permeability zone (4) exhibit substantially reduced permeability to the water stream (6). This modification in geologic permeability causes a greater portion of the water stream (6) to enter through the high-permeability zone (4) and exit via the low-permeability zone (3), increasing contact with and mobilizing previously untapped free hydrocarbons. As a result, the total produced stream—a mixture of fluids from both the low-permeability zone (3) and high-permeability zone (4), shows an improved composition, with a lower water content and a higher hydrocarbons yield ascending the wellbore of the production well (2).

The present disclosure provides methods and stage-by-stage fluid diversion systems that utilize PPG materials and one or more shrinking agents for in-depth fluid diversion in heterogeneous reservoirs. The shrinking agent facilitates the migration of PPG materials to greater distances from the injection well or reactivates water-swelled PPG particles, allowing them to move further into the reservoir.

EXAMPLES

The following examples demonstrate provides methods and stage-by-stage fluid diversion systems for in-depth fluid diversion in heterogeneous reservoirs, as described herein. The examples are provided solely for illustration and are not to be construed as limitations of the present disclosure, as many variations thereof are possible without departing from the spirit and scope of the present disclosure.

Example 1: Stage-by-Stage Fluid Diversion System

Methods and systems for diverting fluid flow in heterogeneous reservoirs using preformed particle gels (PPG) as water-swollen particulate materials combined with one or more shrinking agents are illustrated in FIGS. 1 and 2. The system is designed to redirect flow from high-permeability zones, such as fractures, to adjacent low-permeability areas.

PPG materials, when swollen with water, can effectively pack in high-permeability zones, thereby diverting fluid flow. The shrinking agent in this system serves to either facilitate the migration of PPG through the wellbore to deeper reservoir positions or to reactivate previously packed PPGs, enabling further movement into the reservoir.

The shrinking agents utilized in this method include ultra-high salinity water and solvents such as ethanol. The swelling behavior of PPG is sensitive to the solute concentration. In the presence of high salinity water or ethanol, dry PPG materials absorb minimal liquid, resulting in negligible particle size variation. For the swollen PPG, high salinity water or ethanal can dehydrate the particle to reduced size due to the chemical potential gradient inside and outside of the PPG materials. This size reduction facilitates easier migration of PPG particles within high-permeability zones.

A stage-by-stage injection system as depicted in FIGS. 1 and 2 is employed in oilfield applications to achieve fluid diversion at varying distances relative to the wellbore, such as from near wellbore to deep reservoir.

In the first stage, PPG materials, such as a polyacrylamide-based gel having an initial dry particle size of from about 0.01 mm to about 10 mm, are co-injected with the shrinking agent as the carrier fluid. The shrinking agent is ultra-high salinity water having a salinity of from about 50,000 ppm to about 360,000 ppm. The shrinking agent maintains the PPG in an unswollen or minimally swollen state with small particle sizes, allowing for easy migration into high-permeability zones. Subsequent injection of normal water displaces the shrinking agent, causing the PPG material to swell within the high-permeability zones. This swelling effectively chokes the water flow, achieving fluid diversion at the first targeted position.

In the second stage, the shrinking agent is injected alone, replacing the normal injection water. This causes the previously packed PPG material to shrink back to smaller particle sizes, breaking the PPG pack. The shrunken PPG particles migrate further into the reservoir. Normal water injection is then resumed, prompting the PPG material to swell and repack in deeper reservoir zones, thereby generating fluid diversion at a second position.

Additional stages, replicating the second stage process, can be implemented as necessary to enhance reservoir water flooding sweep efficiency. This stage-by-stage method allows for precise control over fluid diversion, improving the overall efficiency of oil recovery in heterogeneous reservoirs.

Example 2: PPG Swelling Behavior in Injection Water and Ultra-High Salinity Water The swelling behavior of PPG in injection water and ultra-high salinity water was tested. The ultra-high salinity water acted as the shrinking agent. The PPG material was a polyacrylamide-based particle gel with a dry particle size ranging from 0.2 mm to about 0.5 mm (40 mesh to 50 mesh). The salinity of the injection water was 2,425 ppm, while the ultra-high salinity water had a salinity of 213,734 ppm.

Figure 3A:
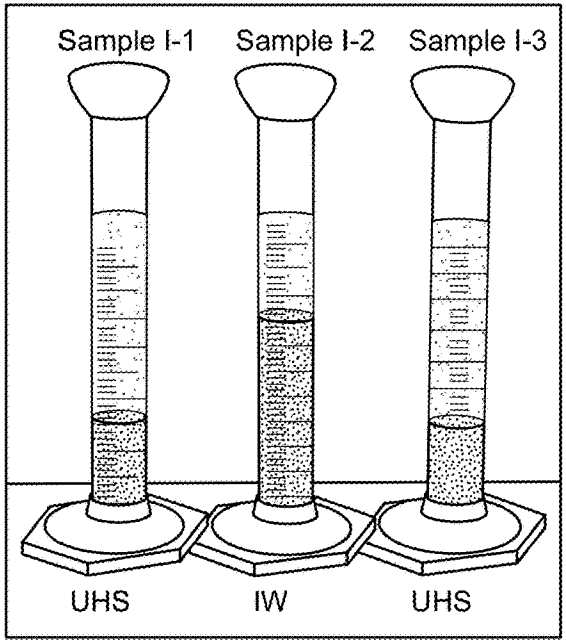
FIG. 3A depicts the swelling behavior of samples 1-1, I-2, and I-3 at the beginning of the test cycle, sample I-1 illustrates preformed particle gel (PPG) in ultra-high salinity water, sample I-2 illustrates PPG in injection water, sample I-3 illustrates PPG in ultra-high salinity water, according to certain embodiments of the present disclosure.
Figure 3B:
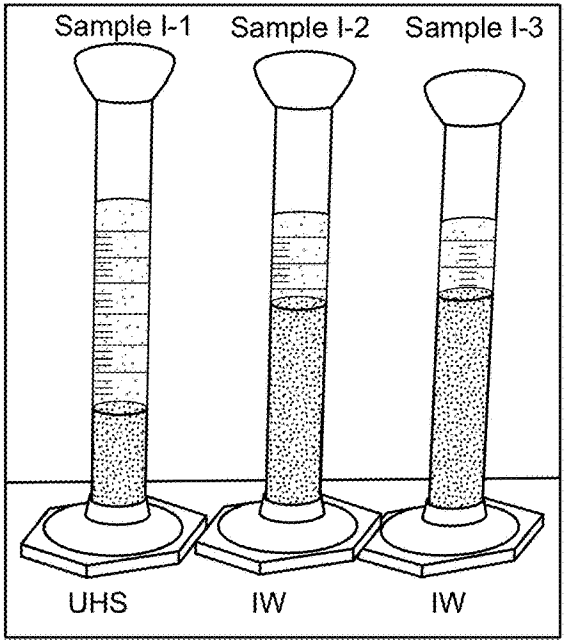
FIG. 3B depicts the swelling behavior of samples 1-1, I-2, and I-3 in the first step of the test cycle, sample I-1 illustrates PPG in ultra-high salinity water, sample I-2 illustrates PPG in injection water, sample I-3 illustrates PPG in injection water that has replaced prior ultra-high salinity water, according to certain embodiments of the present disclosure.
Figure 3C:
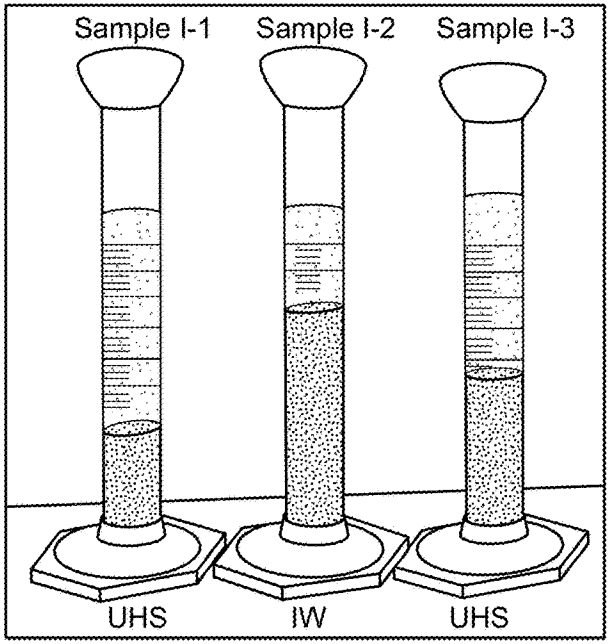
FIG. 3C depicts the swelling behavior of samples 1-1, I-2, and I-3 in the second step of the test cycle, sample I-1 illustrates PPG in ultra-high salinity water, sample I-2 illustrates PPG in injection water, sample I-3 illustrates PPG in ultra-high salinity water that has replaced prior injection water, according to certain embodiments of the present disclosure.

To each of three separate graduated cylinders was added 1.5 g of dry PPG to prepare Sample I-1, Sample I-2, and Sample I-3, as depicted in FIGS. 3A-3C. The first and second cylinders were filled with 10 mL of ultra-high salinity water and injection water, respectively, serving as references to afford Sample I-1 and Sample I-2. In the third cylinder, 10 mL of ultra-high salinity water was initially added to afford Sample I-3, then replaced with injection water, and finally changed back to ultra-high salinity water. FIGS. 3A-3C illustrate the stable volume changes of Sample I-1, Sample I-2, and Sample I-3 in cylinders one, two, and three in the left-right direction, respectively.

As depicted in FIG. 3A, the PPG in ultra-high salinity water (first cylinder, Sample I-1) swelled much less than the PPG in injection water (second cylinder, Sample I-2) with lower salinity. The third cylinder (Sample I-3), initially containing ultra-high salinity water, showed the same swelling behavior as the first cylinder. As depicted in FIG. 3B, when the ultra-high salinity water in the third cylinder (Sample I-3) was replaced with injection water, the PPG volume increased to match that of the second cylinder (Sample I-2). FIG. 3C indicated that after replacing the injection water in the third cylinder (Sample I-3) with ultra-high salinity water, the PPG volume decreased to nearly half of its volume in injection water. These results demonstrate that the swelling of PPG is salinity dependent and revisable with salinity variation. This indicates that ultra-high salinity water can act as a shrinking agent to control PPG particle size, enhancing their migration capability within the reservoir.

Example 3: PPG Swelling Behavior in Injection Water and Ethanol

The swelling behavior of PPG in injection water and ethanol was evaluated, with ethanol acting as the shrinking agent. Similar to Example 2, the PPG used is a polyacrylamide-based particle gel with a dry particle size ranging from 0.2 mm to about 0.5 mm (40 mesh to 50 mesh). The salinity of the injection water was 2,425 ppm, while the ultra-high salinity water had a salinity of 213,734 ppm.

Figure 4A:
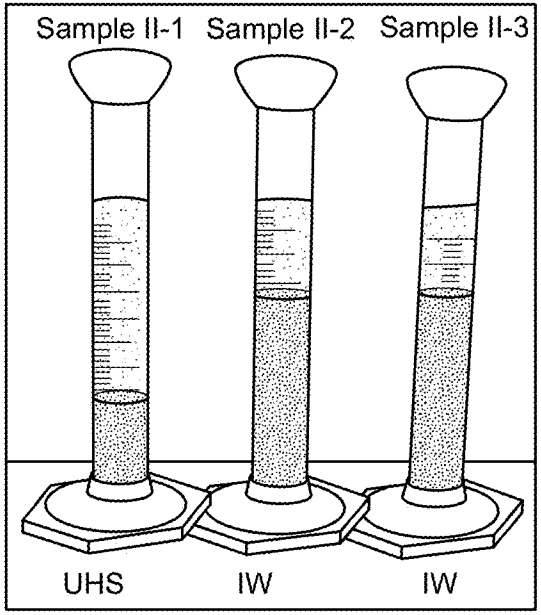
FIG. 4A depicts the swelling behavior of samples II-1, II-2, and II-3 at the beginning of the test cycle, sample II-1 illustrates PPG in ultra-high salinity water, sample II-2 illustrates PPG in injection water, sample I-3 illustrates PPG in injection water, according to certain embodiments of the present disclosure.
Figure 4B:
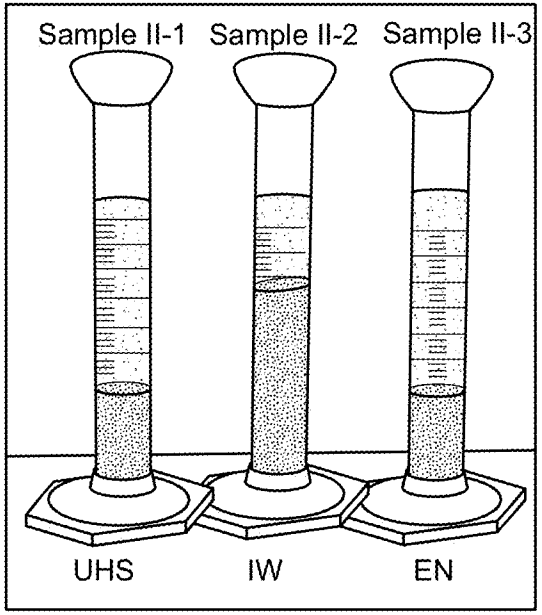
FIG. 4B depicts the swelling behavior of samples II-1, II-2, and II-3 in the first step of the test cycle, sample II-1 illustrates PPG in ultra-high salinity water, sample II-2 illustrates PPG in injection water, sample II-3 illustrates PPG in ethanol that has replaced prior injection water, according to certain embodiments of the present disclosure.
Figure 4C:
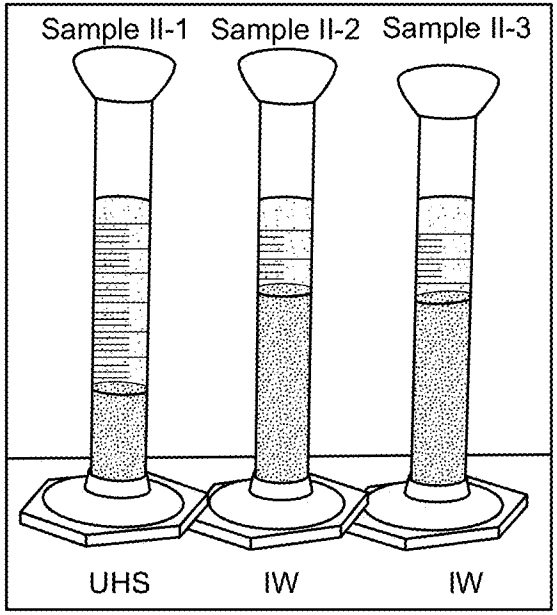
FIG. 4C depicts the swelling behavior of samples II-1, II-2, and II-3 in the second step of the test cycle, sample II-1 illustrates PPG in ultra-high salinity water, sample II-2 illustrates PPG in injection water, sample II-3 illustrates PPG in injection water that has replaced prior ethanol, according to certain embodiments of the present disclosure.

For the test, to each of three separate graduated cylinders was added 1.5 g of dry PPG to prepare Sample II-1, Sample II-2, and Sample II-3, as depicted in FIGS. 4A-4C. The first and second cylinders were filled with 10 mL of ultra-high salinity water and injection water, respectively, serving as references to afford Sample II-1 and Sample II-2. In the third cylinder, 10 mL of injection water was initially added to afford Sample II-3, followed by replacement with ethanol, and finally changed back to injection water. FIGS. 4A-4C illustrate the stable volume changes of Sample II-1, Sample II-2, and Sample II-3 in cylinders one, two, and three in the left-right direction, respectively.

As depicted in FIG. 4A, the third cylinder (Sample II-3), initially filled with injection water, showed a PPG volume similar to that of the second reference cylinder (Sample II-2). As depicted in FIG. 4B, after replacing the injection water in the third cylinder (Sample II-3) with ethanol, the PPG volume decreased rapidly to a level even lower than that observed in the first cylinder (Sample II-1) with ultra-high salinity water. As depicted in FIG. 4C, when ethanol in the third cylinder (Sample II-3) was replaced back with injection water, the PPG volume recovered to its original level before ethanol replacement similar to that of the second reference cylinder (Sample II-2). These results demonstrate that PPG swelling can be effectively controlled by alternating ethanol and water, and the swelling process is reversible. This also indicates that ethanol can serve as the shrinking agent to regulate PPG particle size, enhancing their in-depth migration within the wellbore and reservoir.

Example 4: PPG Migration Test Using Different Injection Waters

Figure 5:
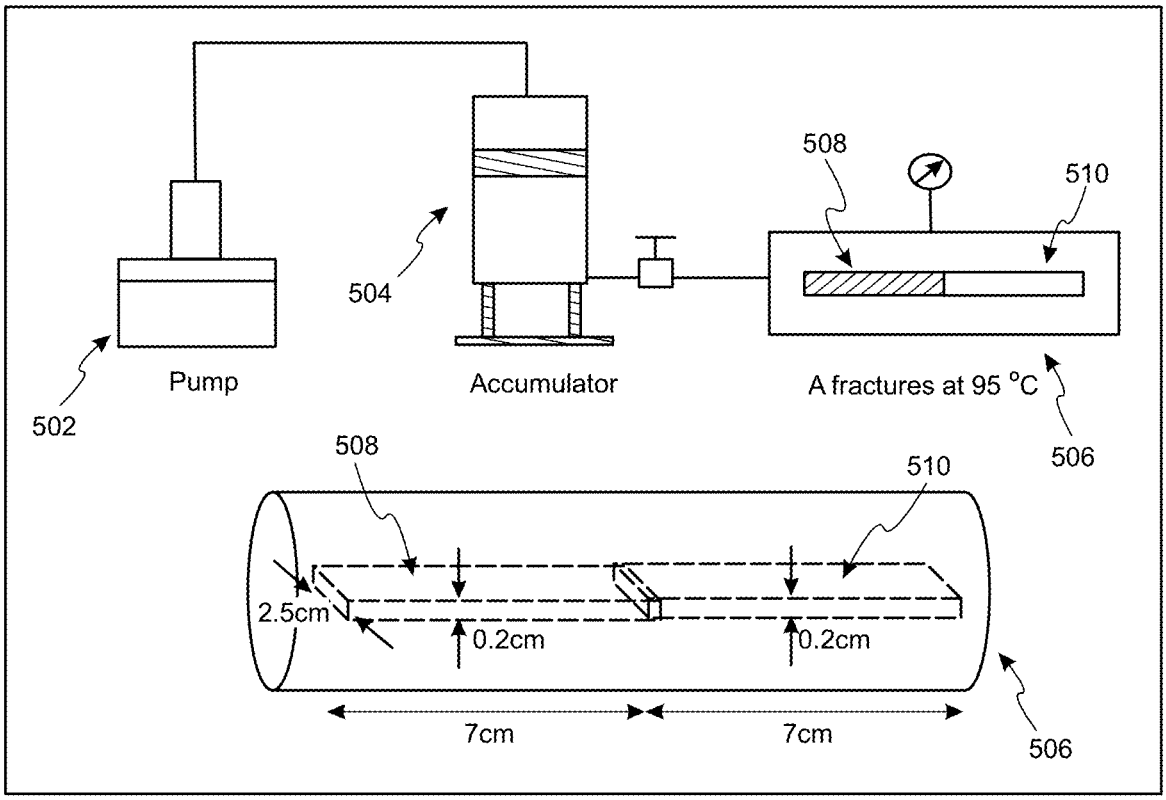
FIG. 5 illustrates a fracture injection system for testing PPG material migration during different injection stages, according to certain embodiments of the present disclosure.

The migration of PPG material induced by variations in water salinity was tested using a fracture injection system, as shown in FIG. 5. The system consisted of an injection pump (502), an accumulator (504), and a fracture setup (506). The fracture injection system was constructed using two metal fractured plugs arranged in series. Each fracture measured 7 cm×2.5 cm×0.2 cm (L×W×H).

0.9 g of a polyacrylamide-based particle gel having a particle size of from 0.1 mm to 0.5 mm (40-100 mesh) was dispersed in high-salinity water with a salinity of about 213,734 ppm and allowed to swell overnight. The swollen PPG material was then manually placed into a first fracture (508), while a second fracture (510) remained empty. The fracture setup was inserted into a holder, with the confining pressure set to 1000 psi and the temperature maintained at 95° C. Low-salinity water with a salinity of 2,425 ppm was injected at a rate of 0.5 mL/min, and the pressure along the entire fracture was recorded. Subsequently, high-salinity water with a salinity of 213,734 ppm, acting as a shrinking agent, was injected at rates ranging from 0.5 mL/min to 4 mL/min, with continuous pressure monitoring. Finally, low-salinity water of a salinity of 2,425 ppm was re-injected at 0.5 mL/min, and the pressure data were recorded to assess the reversibility of PPG swelling and migration behavior as shown in FIG. 6.

Figure 6:
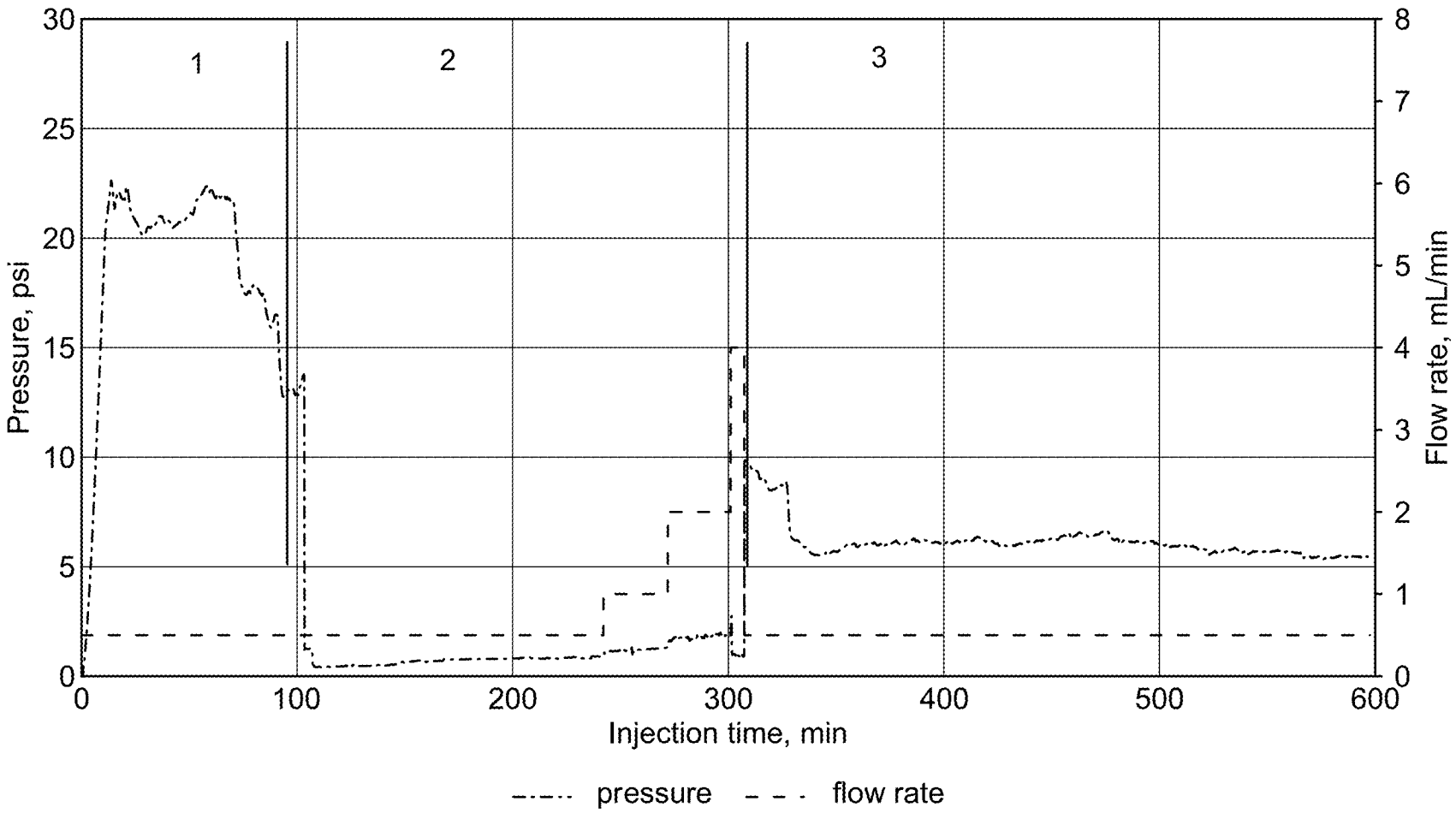
FIG. 6 illustrates the changes of pressure in the fracture injection system during different injection states, according to certain embodiments of the present disclosure.
Figure 7A:
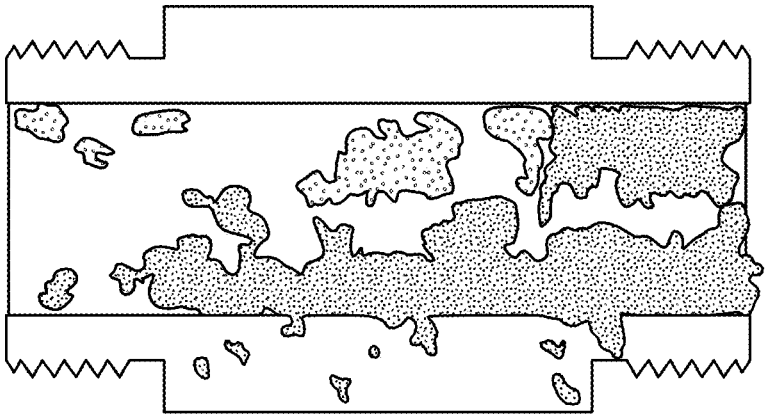
FIG. 7A illustrates the distribution of PPG material at a first fracture position within the fracture injection system, according to certain embodiments of the present disclosure.
Figure 7B:
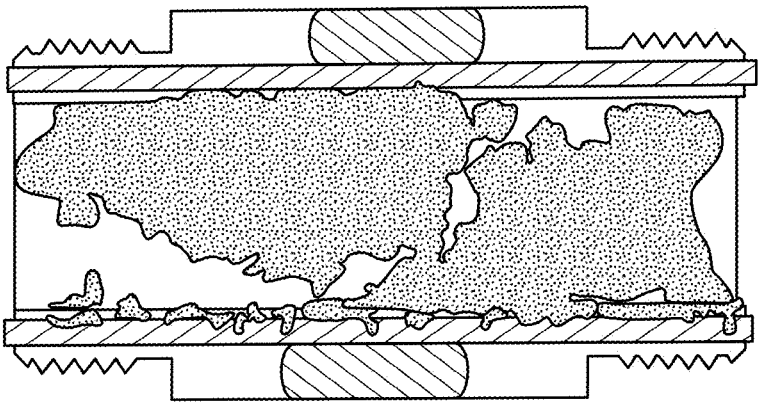
FIG. 7B illustrates the distribution of PPG material at a second fracture position within the fracture injection system, according to certain embodiments of the present disclosure.

FIG. 6 shows the pressure results across different injection stages. In the first stage, low-salinity water was injected, causing the PPG material to swell and form a firm pack within the first fracture (508). This resulted in effective blockage, with a stable pressure of approximately 21.0 psi. In the second stage, the injection of high-salinity water caused the PPG to shrink, loosening the pack and reducing its blocking capability, as indicated by a pressure drop to around 0.8 psi. As the injection flow rate increased, the shrunken PPG became mobilized and migrated into the second fracture (510). In the final stage, low-salinity water was reintroduced, causing the PPG to swell again and create a blockage in the second fracture (510), with a stable pressure of approximately 6.2 psi. FIGS. 7A and 7B illustrate the distribution of PPG material in the first fracture (508) and the second fracture (510), respectively. The results show that after the test, the amount of PPG material in the second fracture (510) is at least ten times greater than in the first fracture (508). This demonstrates that salinity variation effectively promotes the deep migration of PPG material.

Embodiments

Certain embodiments of this disclosure can be implemented as a method for in-depth fluid diversion in a heterogenous reservoir. The method includes a first step and one or more second steps. In the first step, a preformed particle gel (PPG) material and one or more shrinking agents are simultaneously introduced to a first position in a high-permeability zone via an injection well. The introduction of the PPG material and the one or more shrinking agents are terminated, followed by the introduction of water into the high-permeability zone via the injection well. The water is contacted with the PPG material to form water-swelled PPG particles within fractures of the high-permeability zone at the first position. The water-swelled PPG particles in the high-permeability zone can pack the fractures, thereby generating a fluid diversion to control the water flow to an adjacent low-permeability zone.

An aspect combinable with any other aspect can include the following features. The one or more second steps include terminating the introduction of water. The one or more shrinking agents are reintroduced via the injection well to the first position, thereby contacting the one or more shrinking agents with the water-swelled PPG particles within the fractures to convert the water-swelled PPG particles to shrunken PPG particles. The shrunken PPG particles are released from the fractures, thereby flowing to a second position of the high-permeability zone.

An aspect combinable with any other aspect can include the following features. The one or more second steps further include terminating the introduction of the one or more shrinking agents. The water is reintroduced into the high-permeability zone, thereby contacting the water with the shrunken PPG particles to convert the shrunken PPG particles to the water-swelled PPG particles within the fractures of the high-permeability zone at the second position, thereby regenerating the fluid diversion to control the water flow to the adjacent low-permeability zone.

An aspect combinable with any other aspect can include the following features. The PPG material is prepared from a composition comprising one or more monomers, one or more crosslinkers, and one or more fillers.

An aspect combinable with any other aspect can include the following features. The one or more monomers are selected from the group consisting of acrylamide (AM), acrylic acid (AA), and 2-acrylamido-2-methylpropane sulfonic acid (AMPS).

An aspect combinable with any other aspect can include the following features. The one or more monomers comprise acrylamide selected form the group consisting of methacrylamide, N, N-dimethyl (meth)acrylamide, 2-acrylamidoglycolic acid, N-hydroxypropylacrylamide, N-hydroxyethyl acrylamide, N-(tris(hydroxymethyl)methyl)-acrylamide, N-2-aminoethyl (meth)acrylamide hydrochloride, N-3-aminopropyl (meth)acrylamide hydrochloride, and combinations thereof.

An aspect combinable with any other aspect can include the following features. The one or more crosslinkers are selected from the group consisting of N,N-methylenebisacrylamide (MBA), diallyldimethylammonium chloride (DADMAC), and poly(ethylene glycol) diacrylate (PEGDA).

An aspect combinable with any other aspect can include the following features. The one or more fillers are selected from the group consisting of clay, calcium carbonate, and silica.

An aspect combinable with any other aspect can include the following features. The PPG material has a particle size of from about 0.01 millimeters (mm) to about 10 mm.

An aspect combinable with any other aspect can include the following features. The PPG material has a particle size of from about 1 mm to about 5 mm.

An aspect combinable with any other aspect can include the following features. The PPG material has a storage modulus of from about 100 pascals (Pa) to about 100,000 Pa.

An aspect combinable with any other aspect can include the following features. The one or more shrinking agents comprise a salinity water and an alcohol.

An aspect combinable with any other aspect can include the following features. The salinity water has a salinity of from about 50,000 (parts per million) ppm to about 360,000 ppm.

An aspect combinable with any other aspect can include the following features. The alcohol is selected from the group consisting of methanol, ethanol, isopropanol, 1-propanol, ethylene glycol, 1,2-propanediol, 1,3-propanediol, diethylene glycol, and dipropylene glycol.

An aspect combinable with any other aspect can include the following features. The alcohol is ethanol.

An aspect combinable with any other aspect can include the following features. The injection well is selected from the group consisting of a vertical wellbore, a deviated wellbore, a multilateral wellbore, and a horizontal wellbore.

An aspect combinable with any other aspect can include the following features. The injection well is a vertical wellbore.

An aspect combinable with any other aspect can include the following features. The temperature of the heterogenous reservoir is from about 60° C. to about 150° C.

An aspect combinable with any other aspect can include the following features. A pressure at the first position of the high-permeability zone packed with the water-swelled PPG particles is about 1 to about 10 times higher compared to a pressure measured at the first position after converting the water-swelled PPG particles to shrunken PPG particles.

An aspect combinable with any other aspect can include the following features. The second position is at a further distance than the first position relative to the injection well.

When describing the present disclosure, the terms used are to be construed in accordance with the following definitions, unless a context dictates otherwise. Embodiments of the present invention will now be described more fully hereinafter with reference to the accompanying drawings wherever applicable, in that some, but not all embodiments of the disclosure are shown.

Unless otherwise defined, all technical and scientific terms used in this document have the same meaning as commonly understood by one of ordinary skill in the art to which the present application belongs. Methods and materials are described in this document for use in the present application; other, suitable methods and materials known in the art can also be used. The materials, methods, and examples are illustrative only and not intended to be limiting.

In the drawings, like reference numerals designate identical or corresponding parts throughout the several views. As used in this disclosure, the terms "a," "an," and "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (for example, 1%, 2%, 3%, and 4%) and the sub-ranges (for example, 0.1% to 0.5%, 1.1% to 2.2%, and 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

The term "about," as used in this disclosure, can allow for a degree of variability in a value or range, for example, within 10%, within 5%, or within 1% of a stated value or of a stated limit of a range.

As used herein, the terms "particle size" and "pore size" are thought of as the lengths or longest dimensions of a particle and of a pore opening, respectively.

As used herein, the terms "room temperature" or "ambient temperature" refer to a temperature in a range of 25 degrees Celsius (° C.)+3° C. in the present disclosure.

As used herein, the terms "polymer," "polymers," "polymeric," and similar terms are used in their ordinary sense as understood by one skilled in the art, and thus may be used herein to refer to or describe a large molecule (or group of such molecules) that may comprise recurring units, such as monomers. Polymers may be formed in various ways, including by polymerizing monomers and/or by chemically modifying one or more recurring units of a precursor polymer. Unless otherwise specified, a polymer may comprise a "homopolymer" that may comprise substantially identical recurring units that may be formed by, e.g., polymerizing a particular monomer. Unless otherwise specified, a polymer may also comprise a "copolymer" that may comprise two or more different recurring units that may be formed by, e.g., copolymerizing, two or more different monomers, and/or by chemically modifying one or more recurring units of a precursor polymer. Unless otherwise specified, a polymer or copolymer may also comprise a "terpolymer" that may comprise three or more different recurring units. The term "polymer" as used herein is intended to include both the acid form of the polymer as well as its various salts.

Polymers may comprise nonionic, anionic, and/or cationic monomers. The polymer may comprise a nonionic polymer that is later hydrolyzed to comprise carboxylate groups. In some embodiments, hydrolyzation can be produced by heat, adding metal or ammonium hydroxides or sodium carbonate. Polymers may be amphoteric in nature; that is, containing both anionic and cationic substituents, although not necessarily in equal proportions.

As used herein, the term "monomer" generally refers to nonionic monomers, anionic monomers, cationic monomers, zwitterionic monomers, betaine monomers, and amphoteric ion pair monomers.

As used within, the term "crosslinker" generally refers to the use of an agent capable of creating bonds or crosslinks, e.g., covalent bonds or crosslinks, e.g., ionic bonds or crosslinks, between polymer chains during the polymerization. Some embodiments described herein contemplate the use of a "stable crosslinker", e.g., inorganic or organic crosslinker, or combination thereof, which is defined as any crosslinker that does not disintegrate under specific conditions, e.g., one which may be added during the polymerization of the re-crosslinkable PPG to produce a PPG which is swellable in water or brine. Organic cross-linkers may comprise methylene bisacrylamide ("MBA"), hexamethylenetetramine, diallylamine, triallylamine, divinyl sulfone, divinyl benzene, allylmethacrylate, diethyleneglycol diallyl ether and/or phenol aldehyde. In some embodiments, said crosslinker may comprise MBA. In some embodiments, a monomer composition of re-crosslinkable PPGs may comprise at least one crosslinker, e.g., a covalent and/or stable crosslinker. In some embodiments, a stable crosslinker may create covalent bonds or crosslinks between polymer chains ("covalent crosslinker").

As used herein, the terms "polyacrylamide" or "PAM" generally refer to polymers and co-polymers comprising acrylamide moieties, and encompasses any polymers or copolymers comprising acrylamide moieties, e.g., one or more acrylamide (co) polymers. PAMs may be provided in one of various forms, including, for example, dry (powder) form (e.g., DPAM), water-in-oil emulsion (inverse emulsion), suspension, dispersion, or partly hydrolyzed (e.g., HPAM, in which some of the acrylamide units have been hydrolyzed to acrylic acid). PAMs may be used for polymer flooding.

As used herein, the terms "preformed particle gel," "preformed particle gel material," "PPG," or "PPG material" generally refer to water dispersible polymer particles, typically crosslinked polymer particles that may swell after their addition to an aqueous fluid such as fresh or salt water, brine, produced water, flowback water, and/or brackish water. In some embodiments, PPG materials are prepared by first forming a bulk gel comprising a polymer, copolymer, and/or a terpolymer, such as a polymer and/or copolymer comprising acrylamide monomers and/or acrylic acid monomers and/or a terpolymer comprising acrylamide, acrylic acid, and ATBS, a crosslinker, such as MBA, and a filler, such as clay. The PPG material may be subsequently mechanically processed, e.g., by crushing and/or grinding, to produce particles of a desired size range. In some embodiments, the PPG materials are prepared off-site, then brought to a desired location for use. In some embodiments, the PPG materials are deformable, which property facilitates their flowing through porous media even when the PPG material particles are larger than the pore throats.

As used herein, the term "sweep efficiency" generally refers to a measure of the effectiveness of an enhanced oil recovery process that may depend on the volume of the reservoir contacted by the injected fluid.

A weight percent of a component, unless specifically stated to the contrary, is based on the total weight of the formulation or composition in which the component is included. For example, if a particular element or component in a composition or article is said to have 5 wt. %, it is understood that this percentage is in relation to a total compositional percentage of 100%.

In the methods described in this disclosure, the acts can be carried out in any order, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

The invention claimed is:

1. A stage-by-stage fluid diversion system, comprising:
an injection well;
a production well;
a preformed particle gel (PPG) material having a particle size of from 0.05 millimeters (mm) to 10 mm;
a shrinking agent comprising high-salinity water having a salinity of from about 50,000 (parts per million) ppm to about 360,000 ppm; and
a low salinity water stream having a salinity of from 50 ppm to 5,000 ppm;
wherein the injection well and the production well are formed in a heterogenous reservoir comprising a low-permeability zone substantially free of fractures capable of being packed by the PPG material and a high-permeability zone comprising fractures that can be packed by the PPG material, wherein the low-permeability zone is adjacent to the high-permeability zone;
wherein the injection well is in fluid communication with the high-permeability zone in the heterogenous reservoir; and
wherein the production well is in fluid communication with the low-permeability zone and high-permeability zone in the heterogenous reservoir.

2. The system of claim 1, wherein the PPG material and the shrinking agent are simultaneously introduced in the high-permeability zone via the injection well.

3. The system of claim 1, wherein the PPG material has a particle size of from 1 mm to 5 mm.

4. The system of claim 1, wherein the PPG material has a storage modulus of from 100 pascals (Pa) to 100,000 Pa.

5. The system of claim 1, wherein the shrinking agent further comprises an alcohol.

6. The system of claim 5, wherein the alcohol is selected from the group consisting of methanol, ethanol, isopropanol, 1-propanol, ethylene glycol, 1,2-propanediol, 1,3-propanediol, diethylene glycol, and dipropylene glycol.

7. The system of claim 1, wherein the salinity water has a salinity of 213,734 ppm.

8. The system of claim 1, wherein the injection well is selected from the group consisting of a vertical wellbore, a deviated wellbore, a multilateral wellbore, and a horizontal wellbore.

9. The system of claim 8, wherein the injection well is a vertical wellbore.

10. The system of claim 1, wherein the temperature of the heterogenous reservoir is from 60° C. to 150° C.

11. The system of claim 1, wherein the PPG material is prepared from a composition comprising one or more monomers, one or more crosslinkers, and one or more fillers.

12. The system of claim 11, wherein the one or more monomers are selected from the group consisting of acrylamide (AM), acrylic acid (AA), and 2-acrylamido-2-methylpropane sulfonic acid (AMPS).

13. The system of claim 11, wherein the one or more monomers comprise acrylamide selected form the group consisting of methacrylamide, N, N-dimethyl (meth)acrylamide, 2-acrylamidoglycolic acid, N-hydroxypropylacrylamide, N-hydroxyethyl acrylamide, N-(tris(hydroxymethyl) methyl)-acrylamide, N-2-aminoethyl (meth)acrylamide hydrochloride, N-3-aminopropyl (meth)acrylamide hydrochloride, and combinations thereof.

14. The system of claim 11, wherein the one or more crosslinkers are selected from the group consisting of N,N-methylenebisacrylamide (MBA), diallyldimethylammonium chloride (DADMAC), and poly(ethylene glycol) diacrylate (PEGDA).

15. The system of claim 11, wherein the one or more fillers are selected from the group consisting of clay, calcium carbonate, and silica.

16. The system of claim 1, wherein the water is in contact with the PPG material to form water-swelled PPG particles within the fractures of the high-permeability zone at the first position, and the water-swelled PPG particles in the high-permeability zone can pack the fractures, thereby generating a fluid diversion to control the water flow to the adjacent low-permeability zone.

17. The system of claim 16, wherein the shrinking agent is in contact with the water-swelled PPG particles within the fractures to convert the water-swelled PPG particles to shrunken PPG particles, and the shrunken PPG particles are released from the fractures, thereby flowing to a second position of the high-permeability zone.

18. The system of claim 17, wherein the water is in contact with the shrunken PPG particles to convert the shrunken PPG particles to the water-swelled PPG particles within the fractures of the high-permeability zone at the second position, thereby regenerating the fluid diversion to control the water flow to the adjacent low-permeability zone.

19. The system of claim 17, wherein a pressure at the first position of the high-permeability zone packed with the water-swelled PPG particles is 1 to 5 times higher compared to a pressure measured at the first position after converting the water-swelled PPG particles to shrunken PPG particles.

20. The system of claim 17, wherein the second position is at a further distance than the first position relative to the injection well.

* * * * *